United States Patent [19]

Null

[11] 4,299,313

[45] Nov. 10, 1981

[54] MOBILE LUGGAGE CASE HANDLE ASSEMBLY

[75] Inventor: Robert A. Null, Littleton, Colo.

[73] Assignee: Samsonite Corporation, Denver, Colo.

[21] Appl. No.: 166,312

[22] Filed: Jul. 7, 1980

[51] Int. Cl.[3] ..... A45C 5/14; A45C 13/26

[52] U.S. Cl. ..... 190/18 A; 280/47.26; 16/115; 403/85; 190/58 B

[58] Field of Search ..... 190/18 A, 57, 58 B; 280/47.17, 47.19, 47.26, 37; 16/115, 113; 403/85

[56] References Cited

U.S. PATENT DOCUMENTS 3,805,929 4/1974 Kuwayama ..... 190/18 A 3,948,365 4/1976 Gregg et al. ..... 190/18 A

*Primary Examiner*—Donald F. Norton

*Attorney, Agent, or Firm*—George J. Netter

[57] ABSTRACT

A luggage case with a pair of wheels located at the lower edge has a handle assembly that can be folded into a side wall or swung outwardly into pulling (or pushing) relation. A two-part brace maintains a quasi locking of the handle assembly when in the open position such that it may be closed by merely applying a significant rotating force to the assembly about its pivotal interconnection with the case. A latch operates to secure the handle assembly within the case recess when closed or during nonuse and includes a finger actuated button for releasing the latch.

7 Claims, 5 Drawing Figures

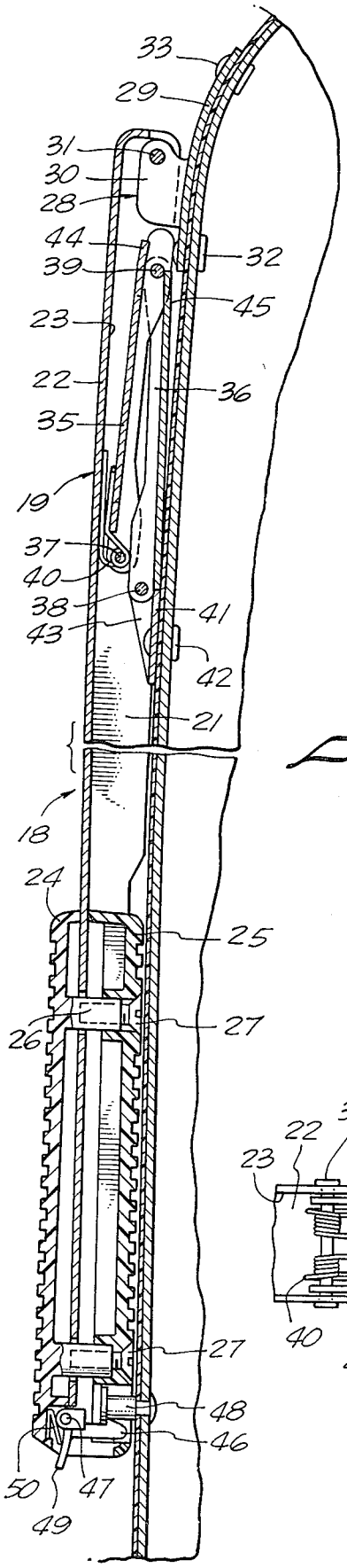
FIG. 3.
FIG. 4.
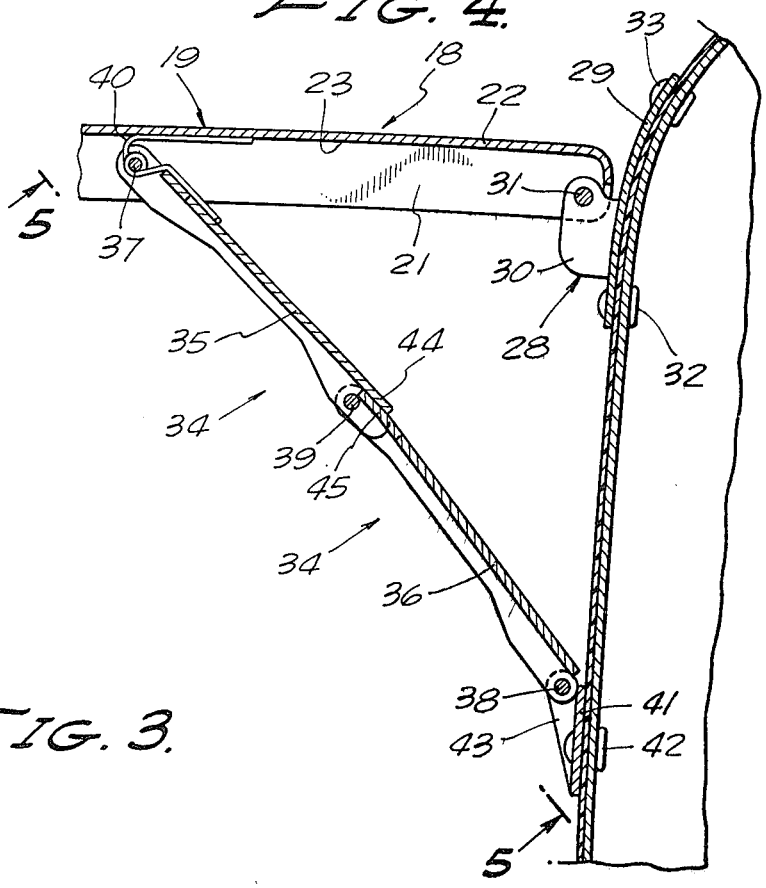
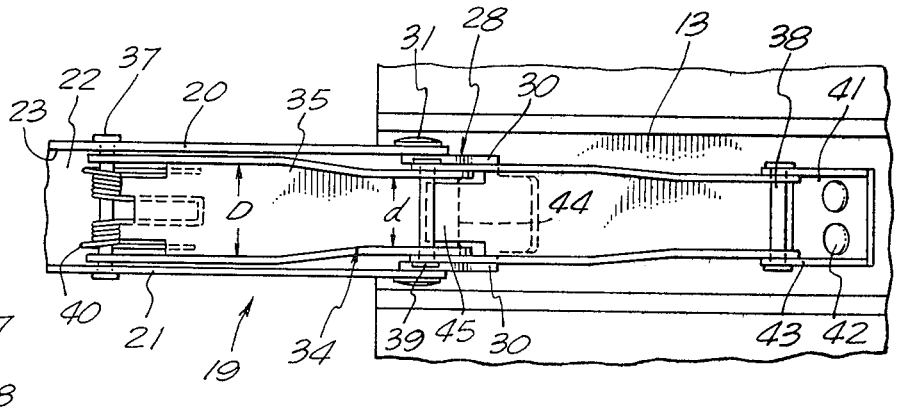
FIG. 5.

MOBILE LUGGAGE CASE HANDLE ASSEMBLY

The present invention relates generally to a mobile luggage case, and, more particularly, to a handle assembly which is integral with the luggage case and for use in pulling or pushing the luggage case.

SUMMARY OF THE INVENTION

In the practice of the invention to be described hereinafter, a luggage case is provided having a pair of wheels located at the lower back edge thereof. The wheels are so mounted with respect to the luggage case that when the case sits flat on a substantially horizontal supporting surface the wheels are held spaced from the floor surface. However, on lifting the case side opposite that including the wheels, the wheels move into rolling contact with the horizontal supporting surface.

The described handle assembly is foldably received in the side wall opposite that including wheels and can be selectively swung outwardly into pulling (or pushing) relation, or, when not in such use can be folded back into a receiving recess formed in the case side wall. The handle assembly is also spring-loaded such that when partially opened the spring resiliently urges the handle toward a completely open position. Moreover, when extended to maintain the handle assembly in its pulling-/pushing mode a two-part brace maintains a quasi locking of the handle assembly in the open position. The handle assembly is closed without requiring manipulation of the brace parts, merely applying a significant rotating force to the assembly about its pivotal interconnection with the case.

A latch operates to secure the handle assembly within the case recess when closed or during nonuse and includes a finger actuated button for releasing the latch.

DESCRIPTION OF THE DRAWINGS

FIG. 3 is a side elevational, sectional, partially fragmentary view taken along the line 3—3 of FIG. 2.

FIG. 4 is an enlarged, side elevational, partially fragmentary, view showing the handle assembly in extended relation to the luggage case.

FIG. 5 is a bottom plan view taken along the line 5—5 of FIG. 4.

DESCRIPTION OF A PREFERRED EMBODIMENT

Figure 1:
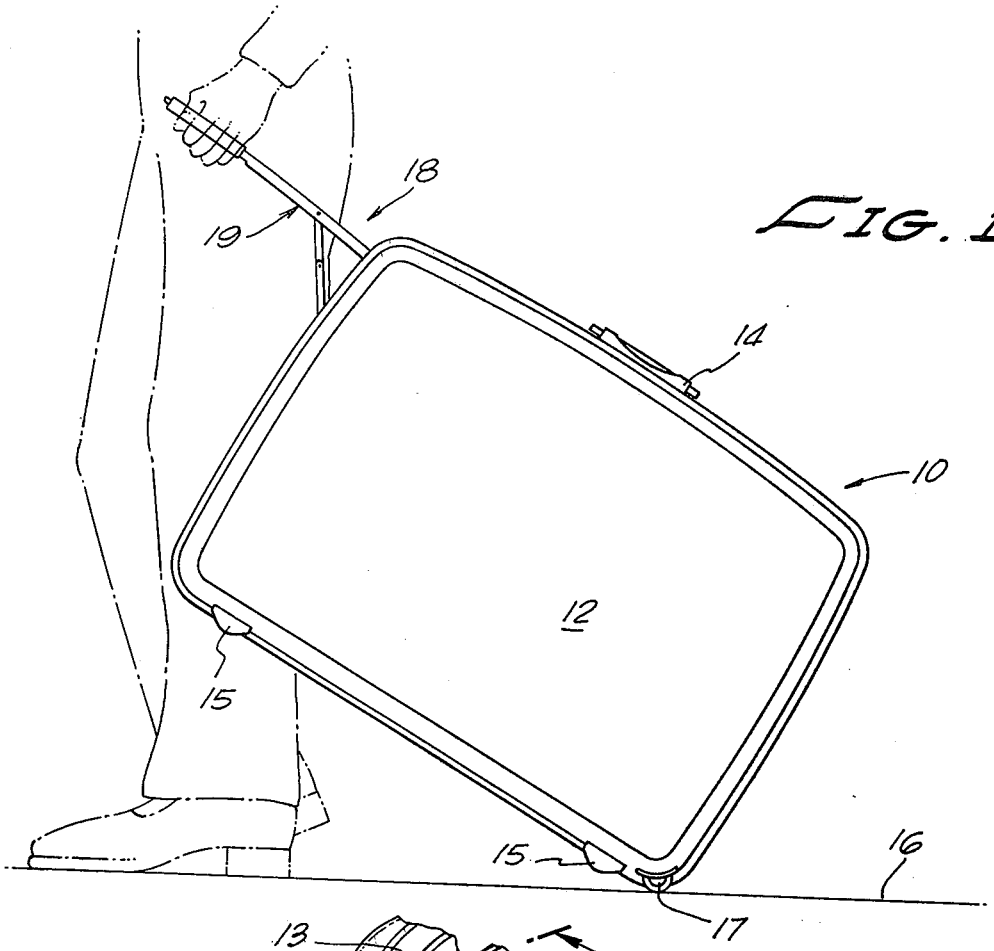
FIG. 1 is a side elevational view of the luggage case and handle assembly of this invention showing the handle assembly extended in the pulling mode.
Figure 2:
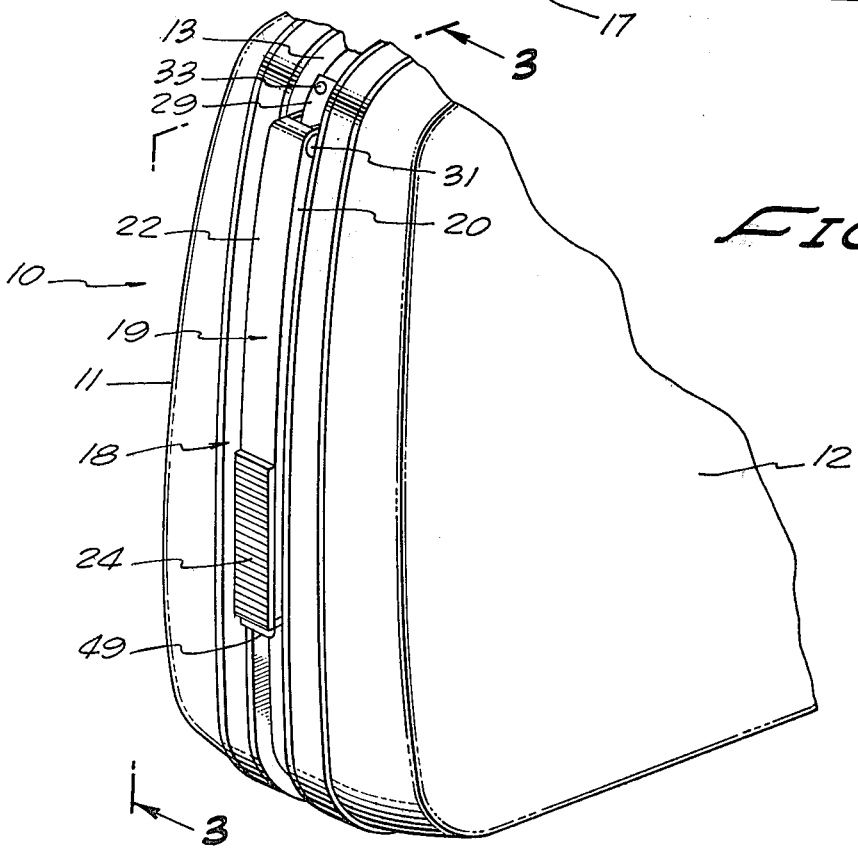
FIG. 2 is a perspective, partially fragmentary view of the end of the luggage case showing the handle assembly in retracted position during nonuse.

Turning now to the drawings and particularly FIGS. 1 and 2 thereof, the luggage case of this invention is enumerated generally as at 10 and is seen to include first and second molded shells 11 and 12 joined together at their facing edges by a recessed channel member 13. A lifting handle 14 of conventional design is provided at the top wall of the case. Four feet or pedestals 15, two adjacent each of the case ends, are provided on the lower surface of the shells 11 and 12 for supporting the case when it is resting on the ground plane or other horizontal surface 16.

On the back lower corner or edge of the luggage case 10, there are provided a pair of wheels 17 extending slightly diagonally outwardly from the case outer surface. The case and wheels are so arranged that when the luggage case rests on the feet or pedestals 15, the wheels will be spaced from the ground plane 16. On the other hand, when the opposite end wall of the case is lifted by a pull handle 18 to be described further herein, and as particularly shown in FIG. 1, the pedestals will be lifted off the ground plane to enable rolling of the luggage case as desired.

The pull handle 18 includes an elongated, generally U-shape in transverse section, member 19 having side walls 20 and 21 and a back wall 22, collectively forming a hollowed-out underside 23. The gripping end of the handle includes first and second plastic or rubber grips 24 and 25 which are secured together about the member 19. More particularly, the grip 25 has a substantial portion thereof received within the hollowed-out underside 23 of the U-shaped member 19 thereby serving to reinforce or strengthen the member. The grip 24 includes integral posts 26 extending through openings in the back wall 22 of member 19 and to which grip 25 is secured via threaded means 27.

The end of the member 19 opposite that containing the grips 24 and 25 is rotatively secured to a mounting member 28 which is affixed to the upper end of the recessed channel member 13. Specifically, the mounting member includes a flat portion 29 lying flush against the channel floor wall, and a pair of spaced upstanding ears 30. A pin 31 passes through the side walls 20 and 21 and the upstanding ears 30 to enable pivoting of the handle member 18 from a closed position in FIG. 3 to an open or pulling position shown in the other drawing figures. Rivets 32 and 33 secure the mounting member 28 within the channel.

As a means for controlling the maximum pivoting extent of the handle and for adding further stability to the handle as well as distributing the pulling load on the luggage case channel, there is provided a brace 34. This brace includes two brace arms 35 and 36 having their outermost ends pivotally connected, respectively, to the handle and the channel, as at 37 and 38. The two brace arms are pivotally interconnected to each other as at 39 enabling the arms to rotate from a fully extending position as in FIG. 4 to one where the arms are closed onto one another as in FIG. 3.

More particularly with respect to details of the brace construction, the arm 35 is stamped metal of U-shaped cross-section with the arm side walls being spaced apart a distance enabling the end portion to be received within the handle member side walls 20 and 21. The pivot pin 37 passes through the side walls 20 and 21 as well as the side walls of the brace 35. A coil spring 40 is received on the pin 37 and includes pressure exerting parts which bear against both the handle member wall 22 and the brace 35 resiliently urging the handle to the open or pulling position.

The brace arm 36 is similar to the arm 35 in that it is of stamped metal construction and U-shaped in cross-section. A mounting bracket 41 affixed to the channel bottom wall by rivets 42, has a pair of upstanding ears 43 via which the pin 38 interconnects with the side walls of the brace 36.

The inner end of the brace arm 35 has a width d which is slightly less than the width D of the opposite end. The small end of 35 is located with its side walls within the side walls of the brace arm 36. The main body wall of brace arm 35 has a tablike end portion 44 which extends over the main body wall of brace 36 when the end portions are fitted together (FIG. 5).

Similarly, brace arm 36 has a tablike end 45 which extends between the side walls of brace 35. Pivot pin 39 links the side walls of the brace arms, such that the tablike ends overlap each other and in that way serve as limit stops to the relative pivoting about 39 in one direction.

More particularly, the two brace arms can pivot from the folded maximum position (FIG. 3) to the maximum open position as in FIG. 4. At the maximum open position, the tablike ends overlap and contact each other maintaining the two brace arms canted at a slight angle to each other with the pivot pin 39 lying off the centerline of pivot pins 37 and 38 in a direction toward pivot 31. It is preferable that the brace arms be disposed to one another at an angle not exceeding about 5 degrees.

This arrangement of brace arms in an almost straight-line condition causes the arms in combination with the action of the spring 40 to assume a semi-locked relationship. Thus, when fully open (FIG. 4) due to the combined action a substantial force must be exerted on the handle 19 to cause the brace arms 35 and 36 to pivot about 39 which is important in maintaining the handle in the open or pulling mode throughout use. Although in general use the luggage case would be pulled as shown in FIG. 1, it may be desired to push the case by the handle 18 and in this situation it is highly advisable that the handle be semi-locked to prevent inadvertent folding up on the hand.

If, on the other hand, the brace arms 35 and 36 were allowed to form a straight line or perhaps even pivot past the straight condition, then the arms would "lock" and the handle could not be closed or folded shut by downward pressure alone. Instead, in the latter case the brace would have to be manipulated by hand thereby running the risk of pinching the fingers or hand.

As a further aspect of this invention, the relative lengths of the handle 18 and the brace 34 are such that the handle will stay extended during normal use in pulling or pushing the luggage case and not fold up inadvertently. For example, if the handle were substantially longer relative to the brace than it is now, there would be a corresponding increase in handle leverage which would cause the brace to collapse more easily on manipulative movements of the handle. On the other hand, if the brace were substantially longer and connected much closer to the outer end of the handle, then the brace would be difficult to close by downward movement of the handle alone.

Accordingly, it has been found that with a handle having a total length of 12 inches (30.48 cm.) from the handle outer end to the pivot 31 provides the previously described advantageous operation with a brace 34 measuring 4.5 inches (11.43 cm.) and is considered to be optimum in this regard.

Also, the handle is preferably interconnected with the channel so as to form an angle A which is slightly less than 90 degrees (e.g., 80 degrees) for ease of pulling. In explanation, since the luggage case must be tilted during use to place the wheels on the ground plane, a handle intersecting the side wall of the case at 90 degrees will tend to slide out of the hand, whereas with the handle directed downwardly a slight amount there is less tendency for the grip to be loosened and it is more comfortable.

Turning once again to FIG. 3, the end of the handle 18 includes a hooklike member 46 mounted on a pin 47 for limited rotative motion about a transverse axis. The hooklike member cooperates with a large-headed stanchion 48 affixed to the channel. A finger lever 49 enables releasing the hooklike member 46 from engagement with the stanchion while spring 50 continuously urges the hooklike member in the direction of engagement.

I claim:

1. A handle assembly for pushing/pulling a luggage case constructed of first and second shells interconnected by a recessed metal channel and having a set of wheels at a lower corner, comprising:

an elongated handle member having an end pivotally connected to the channel; and a brace including a first brace arm having an end pivotally interconnected to the handle member at a point spaced from the member pivotal connection to the channel;

a second brace arm having an end pivotally connected to the recessed channel, and the first and second brace arms being pivotally interconnected to each other with, portions of each brace arm overlapping each other at the pivotal interconnection and coming into contact with each other at one point of the pivoting to form one limit of the extent of pivoting.

2. A handle assembly as in claim 1, in which the pivotal interconnection between the handle member and the first brace arm includes spring means continuously urging the handle member and the first brace arm apart.

3. A handle assembly as in claim 1, in which when the handle member is pivoted to a position of close proximity to the channel the first and second brace arms are folded onto one another with the brace arms common pivot lying closely adjacent the pivotal connection of the handle member and channel, and when the handle member is pivoted away from the channel its maximum amount the brace arms overlapping portions contact each other such that the brace arm common pivot lies off a line drawn through the other two brace arm pivot connections closer to the handle member pivot connection with the channel.

4. A handle assembly as in claim 1, in which the handle member includes first and second grips received on opposite sides of the handle member and secured together by threaded means.

5. A handle assembly as in claim 1, in which the handle member further includes means for cooperating with a large-headed stanchion mounted in the channel to releasably lock the handle member to the channel, said means being released from said stanchion by finger actuation.

6. A handle assembly as in claim 1, in which the handle member measures 12 inches from the outer end to the channel connection and the maximum measurement between the first brace arm interconnection with the handle member and the second brace arm connection to the channel is 4.5 inches.

7. A handle assembly as in claim 1, in which the handle member is a substantially straight line construction and forms an angle with the channel of approximately 80 degrees.

* * * * *